US008393332B2

(12) United States Patent
Kesselman

(10) Patent No.: US 8,393,332 B2
(45) Date of Patent: Mar. 12, 2013

(54) PACKAGING FOR ROLLING PAPERS FOR SMOKING ARTICLES

(75) Inventor: Joshua D. Kesselman, Phoenix, AZ (US)

(73) Assignee: BBK Tobacco & Foods, LLP, Phoenix, AZ (US)

( * ) Notice: Subject to any disclaimer, the term of this patent is extended or adjusted under 35 U.S.C. 154(b) by 730 days.

(21) Appl. No.: 12/392,558

(22) Filed: Feb. 25, 2009

(65) Prior Publication Data

US 2010/0043810 A1 Feb. 25, 2010

Related U.S. Application Data

(63) Continuation-in-part of application No. 12/196,019, filed on Aug. 21, 2008.

(51) Int. Cl.
*A24F 13/00* (2006.01)

(52) U.S. Cl. ..... 131/329; 206/271; D9/711

(58) Field of Classification Search ..... 131/329; 206/271; D9/711
See application file for complete search history.

(56) References Cited

U.S. PATENT DOCUMENTS

| | | | | |
|---|---|---|---|---|
| 266,439 | A | 10/1882 | Daniels, Jr. | |
| 1,145,268 | A | 7/1915 | Rossy | |
| 1,452,993 | A * | 4/1923 | Wack | 248/74.4 |
| 1,479,458 | A | 1/1924 | La Mola | |
| 1,631,048 | A | 5/1927 | Miller | |
| 1,664,160 | A * | 3/1928 | Clement | 206/237 |
| 1,670,343 | A | 5/1928 | Clemens | |
| 1,983,530 | A | 12/1934 | Brandenberger | |
| 1,995,068 | A | 3/1935 | Lim | |
| 2,125,618 | A | 8/1938 | Nystrand | |
| 2,170,147 | A | 8/1939 | Lane | |
| 2,202,322 | A | 5/1940 | Scull | |
| 2,427,957 | A | 9/1947 | Getts | |
| 3,395,714 | A | 8/1968 | Kahane | |
| 3,586,005 | A | 6/1971 | Lippman, Jr. et al. | |
| 3,692,176 | A | 9/1972 | Templeton et al. | |
| D243,350 | S | 2/1977 | Shibata | |

(Continued)

FOREIGN PATENT DOCUMENTS

| | | | |
|---|---|---|---|
| BE | 485679 | A | 11/1948 |
| BR | 9804420 | A | 5/2000 |

(Continued)

OTHER PUBLICATIONS

European Search Report dated Dec. 17, 2009, EP App. No. 09168276.5.

(Continued)

*Primary Examiner* — Richard Crispino
*Assistant Examiner* — Dionne Walls Mayes
(74) *Attorney, Agent, or Firm* — Weiss & Moy, P.C.; Jeffrey D. Moy

(57) ABSTRACT

An improved packaging for rolling papers used in roll your own smoking articles that includes a single member having an inner and an outer surface, the member being folded over towards the inner surface at each end to form a substantially parallel portion at each end and a generally open interior. The unfolded portion of the member extends along a path between the ends. The path includes at least one substantially straight planar portion and a semi-cylindrical portion. The pair of substantially parallel portions are configured such that a plurality of rolling papers may be removably packaged between the pair of substantially parallel portions. The plurality of rolling papers at least initially retains a curved shape after removal from the improved packaging such that a tobacco product may be placed in the curved portion.

16 Claims, 9 Drawing Sheets

U.S. PATENT DOCUMENTS

| | | | |
|---|---|---|---|
| 4,033,358 | A | 7/1977 | Harrington |
| 4,104,431 | A | 8/1978 | Luke |
| 4,146,041 | A | 3/1979 | Laszlo |
| 4,235,189 | A | 11/1980 | Severin |
| 4,290,592 | A | 9/1981 | Kastner |
| 4,435,202 | A | 3/1984 | Koizumi et al. |
| 4,436,202 | A | 3/1984 | Berkley |
| D277,034 | S | 1/1985 | Ramsdell |
| D279,507 | S | 7/1985 | Schechter et al. |
| 4,593,736 | A | 6/1986 | Morita |
| 4,700,840 | A | 10/1987 | Haddock |
| 4,738,390 | A | 4/1988 | Brennan |
| D296,938 | S | 7/1988 | Ameringen |
| 4,775,358 | A | 10/1988 | Jones |
| 4,832,057 | A | 5/1989 | Bale et al. |
| 4,902,361 | A | 2/1990 | Lee et al. |
| 5,080,223 | A | 1/1992 | Mitsuyama |
| 5,094,253 | A | 3/1992 | St. Charles et al. |
| 5,118,554 | A | 6/1992 | Chan et al. |
| 5,284,166 | A | 2/1994 | Cartwright et al. |
| 5,387,108 | A | 2/1995 | Crowell |
| 5,445,199 | A | 8/1995 | Jia |
| 5,462,070 | A | 10/1995 | Rahardja |
| 5,464,073 | A | 11/1995 | Johannes |
| 5,609,269 | A | 3/1997 | Behnke et al. |
| 5,613,958 | A | 3/1997 | Kochinke et al. |
| 5,645,089 | A | 7/1997 | Burger et al. |
| 5,657,773 | A | 8/1997 | George |
| 5,697,127 | A | 12/1997 | Tyler |
| 5,713,406 | A | 2/1998 | Drury |
| 5,752,589 | A | 5/1998 | Berg |
| 5,762,074 | A | 6/1998 | Garner |
| 5,782,246 | A | 7/1998 | Axelrod |
| 5,873,166 | A | 2/1999 | Page |
| 5,927,488 | A | 7/1999 | Gray |
| 5,970,777 | A | 10/1999 | Hunt et al. |
| 6,000,404 | A | 12/1999 | Case et al. |
| 6,041,921 | A | 3/2000 | Staiano et al. |
| D432,263 | S | 10/2000 | Issa |
| 6,164,443 | A | 12/2000 | Mitchell et al. |
| D438,105 | S | 2/2001 | Conner et al. |
| 6,357,448 | B1 | 3/2002 | Sinclair, Jr. |
| 6,427,836 | B1 | 8/2002 | Bolanos |
| 6,446,793 | B1 | 9/2002 | Layshock |
| 6,526,986 | B1 | 3/2003 | Sinclair, Jr. |
| 6,571,803 | B1 | 6/2003 | Bregeard |
| 6,638,613 | B1 | 10/2003 | Bland |
| 6,742,525 | B2 | 6/2004 | Sinclair, Jr. |
| 6,758,906 | B2 | 7/2004 | Maiwald et al. |
| D499,019 | S | 11/2004 | Sagmeister et al. |
| 6,854,471 | B1 | 2/2005 | Sinclair, Jr. |
| 6,920,865 | B2 | 7/2005 | Lyon |
| 6,920,885 | B2 | 7/2005 | Braun |
| 7,048,115 | B2 | 5/2006 | Stringfield |
| D526,086 | S | 8/2006 | Mehta |
| 7,097,896 | B2 | 8/2006 | Merrill |
| 7,136,288 | B2 | 11/2006 | Hoogerdijk |
| 7,172,672 | B2 | 2/2007 | Silverbrook |
| D541,471 | S | 4/2007 | Mitten et al. |
| 7,282,249 | B2 | 10/2007 | Harrison et al. |
| D558,199 | S | 12/2007 | Fiorentino |
| 7,334,725 | B2 | 2/2008 | Dan |
| 7,335,725 | B2 | 2/2008 | Hill et al. |
| 7,344,072 | B2 | 3/2008 | Gonzalez et al. |
| 7,455,176 | B2 | 11/2008 | Focke et al. |
| 2004/0083552 | A1 | 5/2004 | Abrahall |
| 2005/0174004 | A1 | 8/2005 | Takehara et al. |
| 2008/0308431 | A1 | 12/2008 | Kesselmann et al. |
| 2011/0030710 | A1 | 2/2011 | Kesselman |

FOREIGN PATENT DOCUMENTS

| | | | |
|---|---|---|---|
| DE | 3300302 | A1 | 7/1984 |
| DE | 9414404 | U1 | 2/1995 |
| DE | 29502062 | U1 | 6/1996 |
| DE | 19531061 | A1 | 2/1997 |
| DE | 29702285 | U1 | 4/1997 |
| DE | 29722293 | U1 | 3/1998 |
| DE | 20317744 | U1 | 4/2004 |
| DE | 202004007772 | U1 | 10/2004 |
| EP | 0934703 | A1 | 8/1999 |
| EP | 1155974 | A1 | 11/2001 |
| EP | 1382264 | A1 | 1/2004 |
| EP | 2016841 | A2 | 1/2009 |
| FR | 646187 | A | 11/1928 |
| FR | 2767033 | A1 | 2/1999 |
| GB | 26448 | | 0/1913 |
| GB | 2336989 | A | 11/1999 |
| GB | 2336989 | U1 | 11/1999 |
| WO | WO-97/25885 | A1 | 7/1997 |
| WO | WO-97/25886 | A1 | 7/1997 |
| WO | WO-98/20757 | A | 5/1998 |
| WO | WO-98/20757 | A1 | 5/1998 |
| WO | WO-03/020057 | A | 3/2003 |
| WO | WO-2004/056661 | A2 | 7/2004 |
| WO | WO-2006/111956 | A2 | 10/2006 |
| WO | WO-2010/144063 | A1 | 12/2010 |

OTHER PUBLICATIONS

Office Action dated Dec. 23, 2009 for U.S. Appl. No. 29/335,083, filed Apr. 8, 2009.

Office Action dated Jan. 26, 2010 for co-pending U.S. Appl. No. 11/763,865.

Office Action dated Oct. 15, 2010, U.S. Appl. No. 11/763,865, filed Jun. 15, 2007.

Office Action dated Nov. 24, 2010, U.S. Appl. No. 12/196,019, filed Aug. 21, 2008.

Office Action dated May 27, 2011, U.S. Appl. No. 12/196,019, filed Aug. 21, 2008.

Notice of Allowability for Design U.S. Appl. No. 29/323,269, filed Aug. 21, 2008.

European Search Report dated Oct. 8, 2008 for EP 08010433.4, filed Jun. 9, 2008.

Office Action, dated Nov. 8, 2011 for U.S. Appl. No. 12/196,019, filed Aug. 21, 2008.

European Search Report, dated Sep. 14, 2011, EP App. No. EP11166601.2.

Office Action, dated Dec. 7, 2011, U.S. Appl. No. 12/714,230, filed Feb. 26, 2010.

http://en.wikipedia.org/wiki/Neodymium_magnet.

Office Action dated Mar. 13, 2012 U.S. Appl. No. 12/884,728, filed Sep. 17, 2010.

How to roll your own cigarettes, www.ryoguide.com, downloaded Dec. 2009.

EP Search Report (partial) dated Dec. 15, 2011 for EP 11181430.7 filed Sep. 15, 2011.

Response dated Jan. 26, 2010 to Office Action dated Dec. 23, 2009 U.S. Appl. No. 29/335,083, filed Apr. 8, 2009.

Response dated Aug. 15, 2008 to Office Action dated Feb. 15, 2008 U.S. Appl. No. 29/261,575.

Response—Pre Appeal Brief dated Feb. 23, 2009 U.S. Appl. No. 29/261,575, filed Jun. 14, 2006.

Office Action dated Jun. 17, 2009 U.S. Appl. No. 29/261,575, filed Jun. 14, 2006.

Response—Appeal Brief dated Oct. 16, 2009 U.S. Appl. No. 29/261,575, filed Jun. 14, 2006.

Office Action dated Jan. 5, 2010 (Answer to Appeal Brief filed Oct. 16, 2009) U.S. Appl. No. 29/261,575, filed Jun. 14, 2006.

Response—Reply to Examiners Reply dated Mar. 4, 2010 U.S. Appl. No. 29/261,575, filed Jun. 14, 2006.

Response dated Oct. 4, 2011 to Office Action dated Jul. 5, 2011 U.S. Appl. No. 12/714,230, filed Feb. 26, 2010.

Response dated Mar. 2, 2012 to Office Action dated Dec. 7, 2011 U.S. Appl. No. 12/714,230, filed Feb. 26, 2010.

Response dated Sep. 16, 2011 to Office Action dated May 27, 2011 U.S. Appl. No. 12/196,019, filed Aug. 21, 2008.

Response dated Dec. 29, 2011 (CPA/RCE) dated Dec. 19, 2011 to Office Action dated Nov. 8, 2011 U.S. Appl. No. 12/196,019, filed Aug. 21, 2008.

Response dated Aug. 16, 2007 to Office Action dated May 14, 2007 U.S. Appl. No. 10/922,048, filed Aug. 19, 2004.

Response dated May 22, 2009 to Office Action dated Feb. 25, 2009 U.S. Appl. No. 11/746,503, filed May 9, 2007.
Office Action (final) dated Aug. 20, 2009 U.S. Appl. No. 11/746,503, filed May 9, 2007.
Office Action dated Aug. 27, 2009 U.S. Appl. No. 11/671,892, filed Feb. 6, 2007.
Response dated Jul. 9, 2009 to Office Action dated Mar. 3, 2009 U.S. Appl. No. 11/778,035, filed Jul. 14, 2007.
Office Action dated Nov. 30, 2009 U.S. Appl. No. 11/778,035, filed Jul. 14, 2007.
Response dated May 22, 2009 to Office Action dated Feb. 23, 2009 U.S. Appl. No. 11/763,865, filed Jun. 15, 2007.
Office Action dated Aug. 3, 2009 U.S. Appl. No. 11/763,865, filed Jun. 15, 2007.
Response dated Sep. 28, 2009 to Office Action dated Aug. 3, 2009 U.S. Appl. No. 11/763,865, filed Jun. 15, 2007.
Office Action (advisory) dated Oct. 8, 2009 U.S. Appl. No. 11/763,865, filed Jun. 15, 2007.
Response (RCE) dated Oct. 27, 2009 to Office Action dated Aug. 3, 2009 U.S. Appl. No. 11/763,865, filed Jun. 15, 2007.
Response dated Jun. 28, 2010 to Office Action dated Jan. 26, 2010 U.S. Appl. No. 11/763,865, filed Jun. 15, 2007.
Office Action (noncompliant) dated Jul. 9, 2010 U.S. Appl. No. 11/763,865, filed Jun. 15, 2007.
Response dated Aug. 5, 2010 to Office Action dated Jan. 26, 2010 U.S. Appl. No. 11/763,865, filed Jun. 15, 2007.
Response (appeal brief) dated Apr. 8, 2011 to Office Action dated Oct. 15, 2010 U.S. Appl. No. 11/763,865, filed Jun. 15, 2007.
Office Action (defective brief) dated Apr. 22, 2011 U.S. Appl. No. 11/763,865, filed Jun. 15, 2007.
Response (substitute appeal bried) dated May 13, 2011 to Office Action dated Oct. 15, 2010 U.S. Appl. No. 11/763,865, filed Jun. 15, 2007.
Office Action (examiner's answer) dated Aug. 3, 2011 U.S. Appl. No. 11/763,865, filed Jun. 15, 2007.
Response (reply brief) dated Sep. 26, 2011 to Office Action dated Aug. 3, 2011 U.S. Appl. No. 11/763,865, filed Jun. 15, 2007.
Office Action Dated Jul. 5, 2011 U.S. Appl. No. 12/714,230, filed Feb. 26, 2010.

* cited by examiner

PACKAGING FOR ROLLING PAPERS FOR SMOKING ARTICLES

CROSS REFERENCE TO RELATED APPLICATIONS

This application is a continuation-in-part of U.S. application Ser. No. 12/196,019, filed on Aug. 21, 2008, entitled IMPROVED PACKAGING FOR SMOKING ARTICLES.

BACKGROUND OF THE INVENTION

1. Field of the Invention

This invention is related in general to the field of products used by an end user to create their own cigars or cigarettes. More particularly, the invention is related to an improved packaging for rolling papers used in roll your own smoking articles.

2. Discussion of the Background

Many end users prefer to roll their own smoking articles, such as cigars, cigarettes or the like. Papers or other sheets of material used as the outer wrapper for smoking articles are commonly made from leaves or pulp derived from a variety of sources, such as, wood, rice, cellulose, flax, plant fibers, packed herbs, palm leaf, tobacco, paper or some combination of the foregoing (collectively referred to herein as "rolling paper"). Rolling papers can be used to roll cigarette tobacco, cigar tobacco, pipe tobacco, tobacco substitutes, herbs, and most any other similar material. The papers are distributed and sold in individual packs that include an outer packaging, which typically serves to protect and sometimes preserve the rolling papers therein. That packaging typically maintains the rolling papers in either a basically flat or folded shape. In some instances, certain types of paper, such as, paper made from reconstituted tobacco, is packaged as a rolled tube of one or more sheets of paper, and in some instances, that tube is wrapped tightly around a plastic straw or other casing as discussed below.

To roll a smoking article, an end user typically removes one or more rolling papers from its packaging, manipulates the one or more rolling papers (as discussed in detail below), places a desired amount of tobacco in the one or more rolling papers, and rolls the one or more rolling papers into a tubular shape. The tubular shape is then sealed using adhesive or moisture, and allowed to dry to form a shell, which contains the tobacco product. After drying, the smoking article may be smoked by the end user.

A problem associated with rolling your own smoking articles is that it is often difficult for an end user to actually roll the smoking article. The end user has to be skillful in carefully adding the tobacco in the rolling paper and in rolling the cigarette. When rolling the smoking article tension must be maintained on the paper itself and pressure maintain on the tobacco therein in order to roll a preferred smoking article, where the outer paper is relatively firm and the tobacco therein is sufficiently compressed to prevent air channels through the length thereof. Hence, while rolling the article, the end user must maintain tension on the paper and pressure on the tobacco without tearing or puncturing the paper itself.

Existing packaging for rolling papers, which maintains the rolling papers in either a basically flat shape or a tubular shape, often increases the difficulty in rolling the smoking article. In particular, rolling paper that is contained within packaging having a flat shape requires the end user to manipulate the rolling paper by folding the rolling paper after determining where to fold the rolling paper. The user then inserts the tobacco product, and rolls the rolling paper such that it will hopefully remain in place while rolling a preferred smoking article as discussed above. Paper products that are folded, and typically interleaved, in the packaging present additional problems. These paper products include a v-fold usually in the middle of the rolling paper. The end user is required to re-fold the paper, which in some cases is problematic. Also problematic is that the original fold does not fully disappear. In particular, the v-fold often does not allow for efficient rolling and sealing of the paper and may result in undesirable characteristics in the smoking product, such as, smoking articles having undesirable air channels along the original v-fold in which air may be pulled through.

U.S. Pat. No. 6,742,525 discloses the above-mentioned conventional form of packaging rolling papers in a tubular shape. It depicts and describes rolling paper tightly wound around a form, which may or may not be included in the rolling paper as it is placed in a resealable packet for sale to end-users. When the end user removes a tube of rolling paper from the sealed packet, the rolling paper generally retains its coiled shape. To create a smoking article, an end user is required to first carefully unroll the coiled paper, and maintain pressure on it so that the paper does not recoil. As such, the rolling paper is difficult to unroll without damaging the paper and unstable for adding tobacco products. After unrolling the rolling paper, the end user typically bends and folds the rolling paper as desired, inserts the tobacco product, and rerolls the paper to create a smoking article. Hence, this conventional manner of packaging rolling papers makes it more difficult to create a suitable smoking article and more difficult to do so without damaging the rolling paper. Also, this method of packaging rolling papers is not suitable for many types of paper where the recoil of the paper after rolling and packaging would be so strong that it would be difficult to unroll the paper and create a smoking article without damaging the paper.

U.S. Pat. No. 6,526,986, also issued to Sinclair, attempts to address the difficulty in making roll your own smoking articles with a cigar shell. That shell is created by rolling several sheets of rolling paper or leaves of tobacco around a casing to form an outer cigar shell. Once the cigar shell is formed in that manner, it is left to dry. Once dried, the casing is removed and the cigar shell is cut longitudinally so that an inner void, once occupied by the casing, within the cigar shell can be exposed by the end user by prying the sides of the shell apart. That void is then filled with tobacco by the end user, and the edges of the longitudinal cut are moistened so that the cigar shell can be sealed. While this product addresses the difficulty of creating a roll your own smoking article, that solution has drawbacks. The cigar shell is more expensive to manufacture than the rolling paper typically used to make a cigar or other smoking article, and the end user must consume the bulky casing along with the tobacco inserted therein. Also, the end user still must struggle with the recoil of the cigar casing when attempting to make the smoking article.

Existing packaging and the rolling paper contained therein is therefore inherently difficult to use and are not conducive to rolling the smoking article. Thus, as noted above, there currently exist numerous deficiencies in packaging for smoking articles that are known in the prior art.

SUMMARY OF THE INVENTION

Accordingly, one aspect of the present invention is to provide an improved packaging for rolling papers used in roll your own smoking articles that includes a pair of substantially parallel members connected together at each end to form a generally open interior. The pair of substantially parallel members extend along a path between the ends. The path includes at least one substantially straight planar portion and a semi-cylindrical portion. The pair of substantially parallel members are configured such that a plurality of rolling papers may be removably packaged between the pair of substantially parallel members. The one or more rolling papers at least initially retains a curved shape, which may be substantially the same as the path between the pair of substantially parallel members, after removal from the improved packaging such that a tobacco product may be placed in the curved portion.

In another embodiment of the invention, the improved packaging for rolling papers includes a single member folded over towards an inner surface at each end to form a substantially parallel portion at each end and a generally open interior. The unfolded portion of the member extends along a path between the ends. The path includes at least one substantially straight planar portion and a semi-cylindrical portion. The pair of substantially parallel portions are configured such that a plurality of rolling papers may be removably packaged between the pair of substantially parallel portions. The open interior allows the end-user to place tobacco in the semi-cylindrical portion so that the tobacco can be formed and shaped, i.e., pre-formed, by the end-user by compressing the tobacco into a tubular shape using the packaging. To roll the smoking article, the ends of a rolling paper can be removed from under the substantially parallel portions at each end of the packaging, and the packaging, which is made of a flexible material, such as, a thin plastic, in this embodiment, can be used to roll the smoking article without removing the paper therefrom.

Alternately, after the packaging has been used to pre-form the tobacco, the paper can be removed from the packaging to roll the smoking article. When removed from the packaging, the rolling paper at least initially retains a curved shape, which may be substantially the same as the path of the unfolded portion of the member, thereby retaining the pre-formed tobacco and allowing the end-user to create a suitable smoking article without reshaping or folding the rolling paper. Once formed, the end user may place the smoking article in the curved portion of the packaging, and manipulate the packaging so that the smoking article is rolled repeatedly, back and forth in the curved portion of the packaging, thereby further compressing the tobacco within the smoking article and further tightening the rolled paper around the tobacco to create a preferred smoking article, having the characteristics discussed above.

Another aspect of the present invention is to provide a method for packaging rolling papers for smoking articles that includes connecting a pair of substantially parallel members together at each end to form a generally open interior there between, arranging the pair of substantially parallel members to extend along a path between the ends, and removably packaging a plurality of rolling papers between the pair of substantially parallel members. The path includes at least one substantially straight planar portion and a semi-cylindrical portion. The packaging includes a semi-circular or other shaped void on one or both sides of one end to enhance the ease of removal of an individual sheet of rolling paper by an end-user and includes an obstruction, such as, a fold, notch or adhesive, that prevents the rolling papers from slipping out of the other end of the packaging.

In another embodiment of the invention, the method for packaging rolling papers for smoking articles includes folding each end of a single member having an inner and outer surface folded towards the inner surface to form a substantially parallel portion at each end and a generally open interior, arranging the unfolded portion of the member to extend along a path between the ends, and removably packaging a plurality of rolling papers between the pair of substantially parallel portions. The path includes at least one substantially straight planar portion and a semi-cylindrical or curved portion. The packaging includes a semi-circular or other shaped void on one end to enhance the ease of removal of an individual sheet of rolling paper by an end-user and includes an obstruction, such as, a fold, notch or adhesive, that prevents the rolling papers from slipping out of the other end of the packaging.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DETAILED DESCRIPTION OF THE PREFERRED EMBODIMENTS

Figure 1:
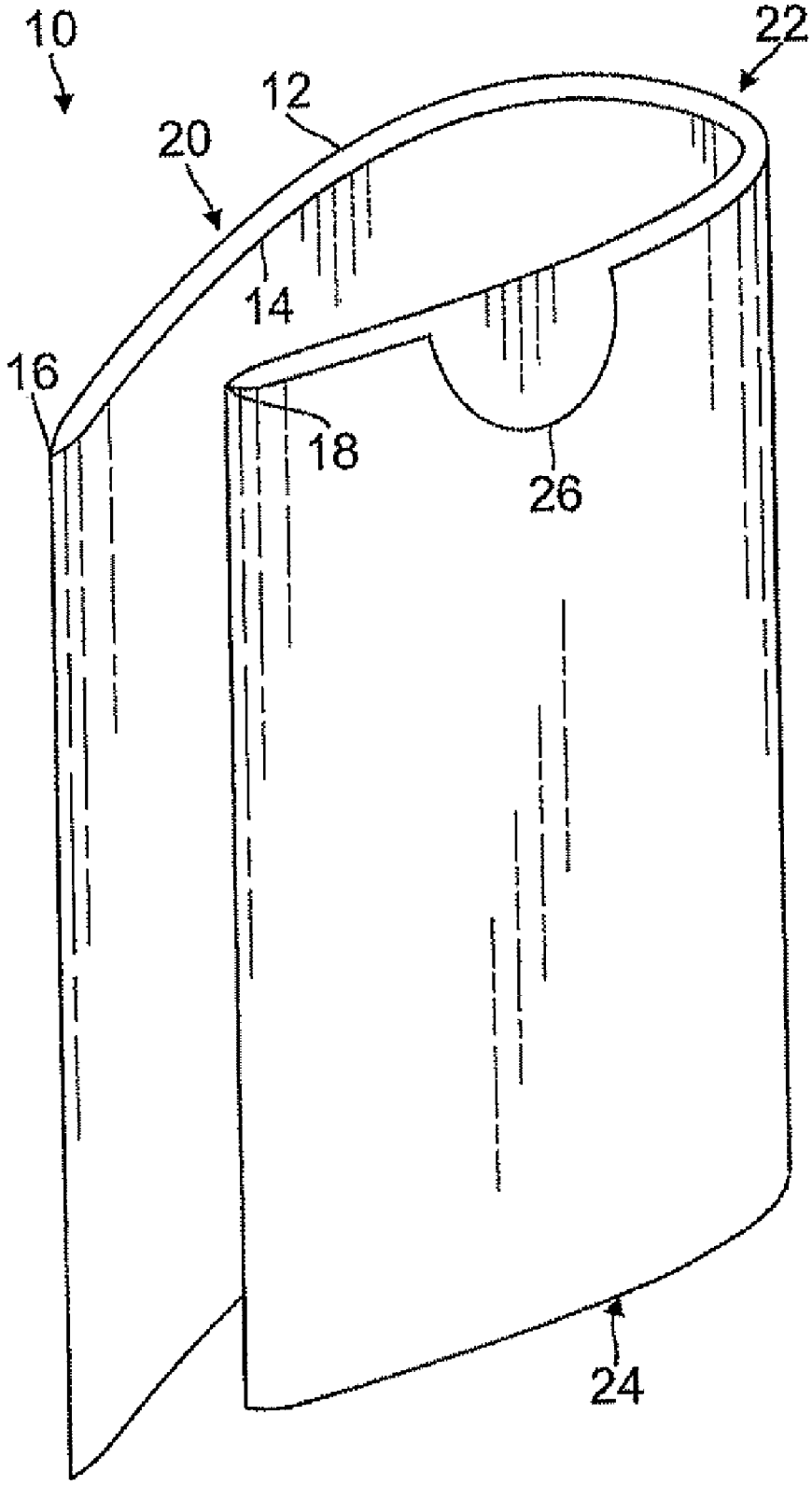
FIG. 1 is a side perspective view of an improved packaging for rolling papers for smoking articles according to an embodiment of the present invention.
Figure 2:
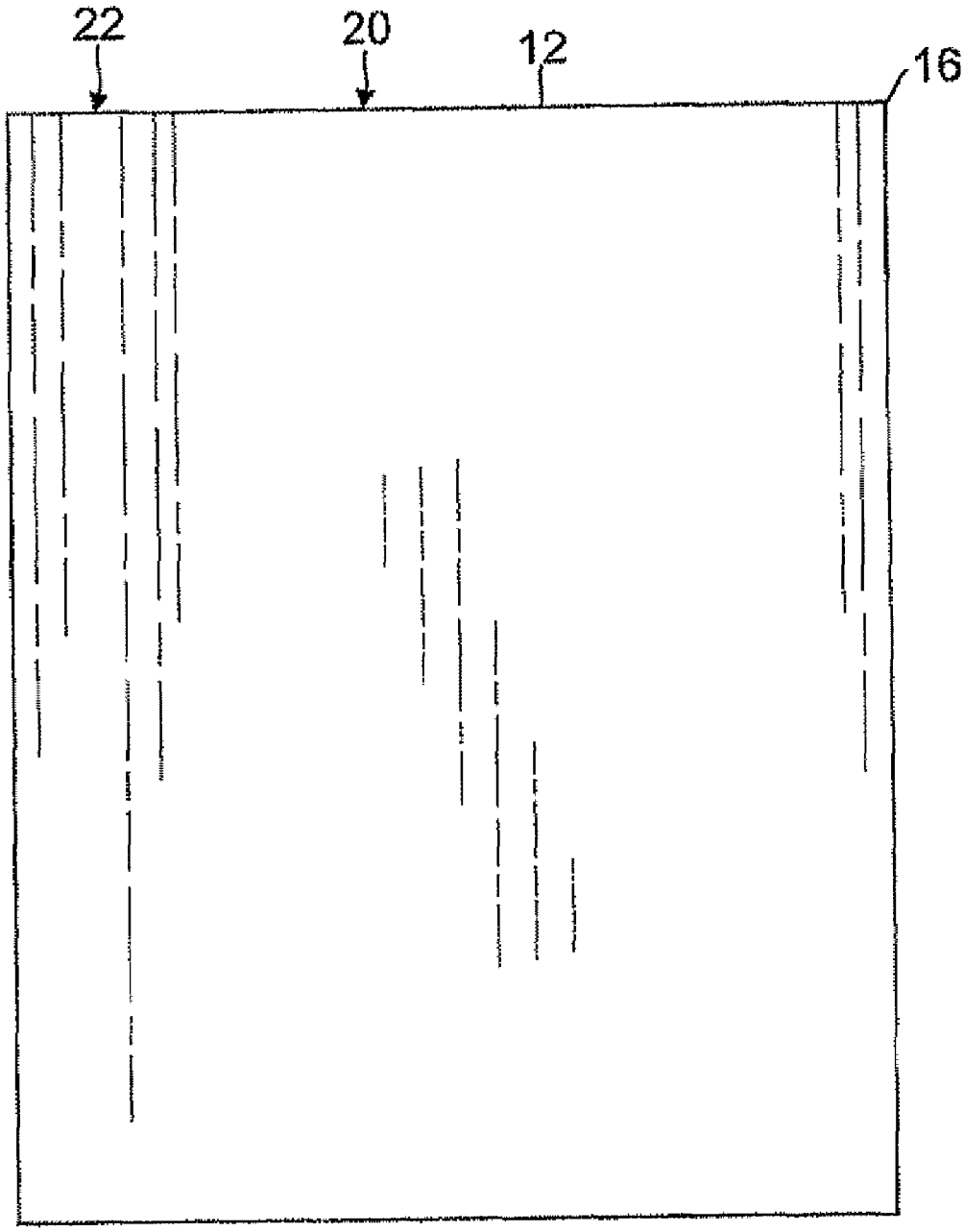
FIG. 2 is a left side view of the improved packaging for rolling papers for smoking articles according to an embodiment of the present invention.
Figure 3:
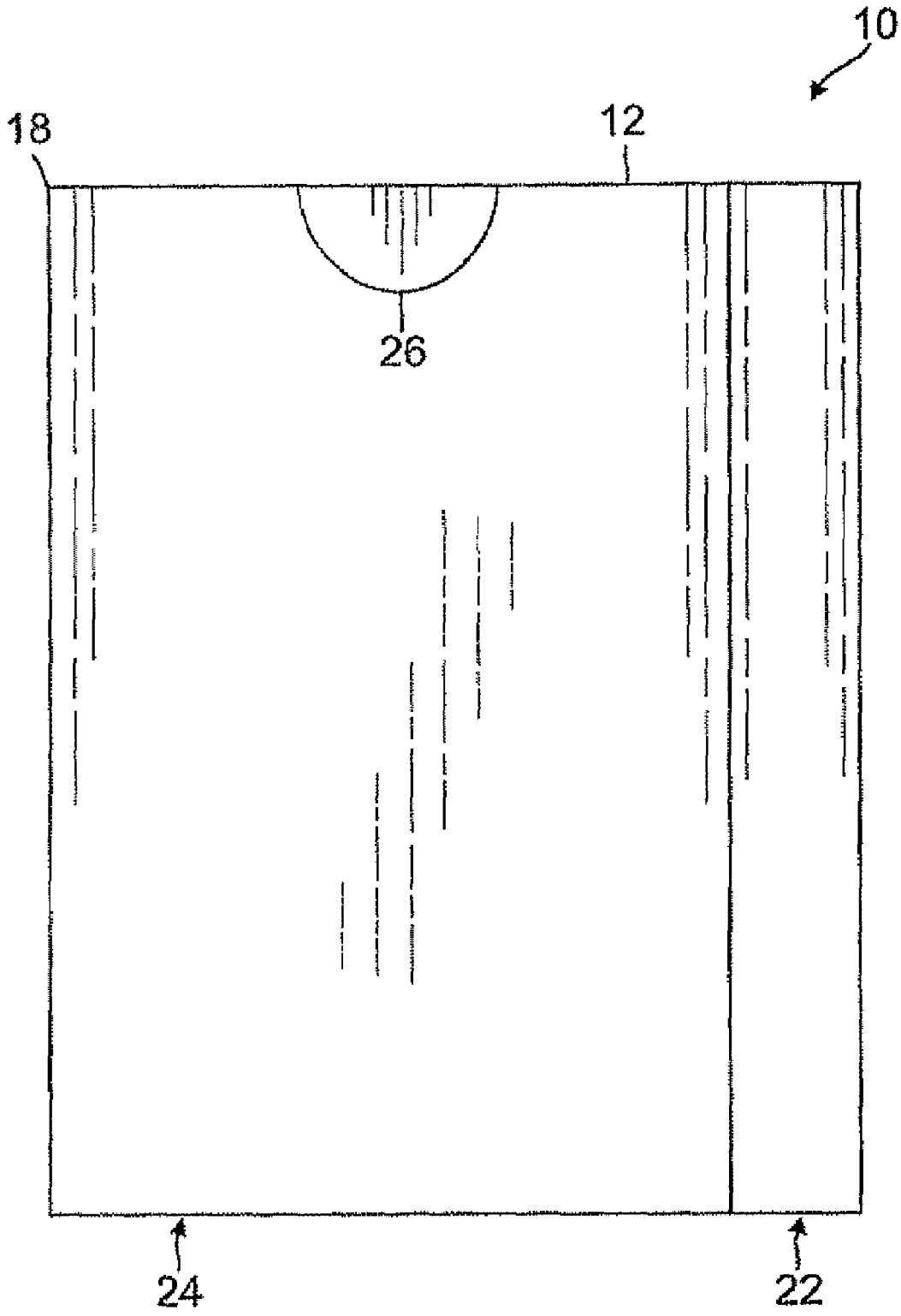
FIG. 3 is a right side view of the improved packaging for rolling papers for smoking articles according to an embodiment of the present invention.
Figure 4:
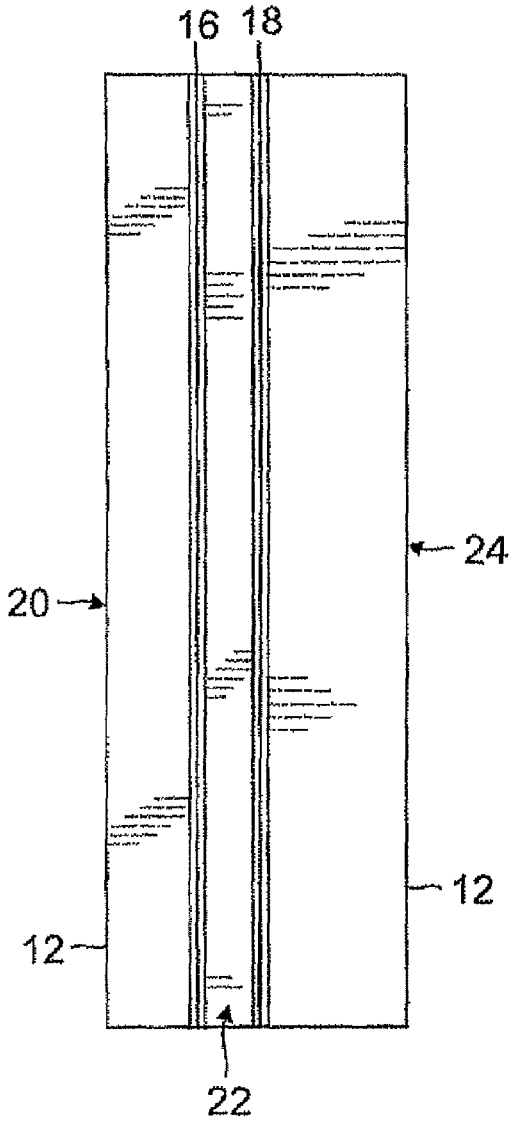
FIG. 4 is a front elevation view of the improved packaging for rolling papers for smoking articles according to an embodiment of the present invention.
Figure 5:
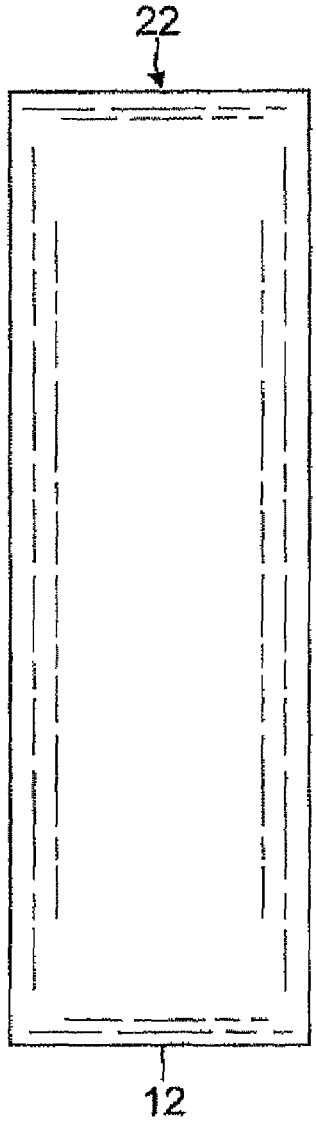
FIG. 5 is a rear elevation view of the improved packaging for rolling papers for smoking articles according to an embodiment of the present invention.

Referring now to the drawings, wherein like reference numerals designate identical or corresponding parts throughout the several views, preferred embodiments of the present invention are described.

Many end users prefer to roll their own smoking articles, such as cigars, cigarettes or the like. As discussed above, it is often difficult for an end user to roll the smoking article. The end user has to be skillful in carefully adding the tobacco to the rolling paper, and in rolling the paper while applying sufficient pressure and tension to the paper without damaging the paper. Existing packaging for rolling papers, which maintains the rolling papers in either a basically flat shape or a tubular shape, often increases the difficulty in rolling the smoking article. The packaging of the present invention not only solves various problems associated with conventionally packaged papers, it also can be used as a platform on which to roll a smoking article or as a tool to improve the characteristics of a rolled smoking article.

Referring now to FIGS. 1-7, an improved packaging 10 for rolling papers for smoking articles according to an embodiment of the present invention is shown. The packaging 10 includes two substantially parallel members 12 and 14 connected together at respective end portions, 16 and 18. The packaging 10 may also be formed from a single member having an inner side 14 and an outer side 12.

At least one opening is formed between parallel members 12 and 14. As shown in FIG. 1, the at least one opening extends from a top portion of members 12 and 14 substantially there through to a bottom portion of members 12 and 14. Optionally, the opening extends from the top portion of the members 12 and 14 to an opening at the bottom portion of members 12 and 14.

Figure 6:
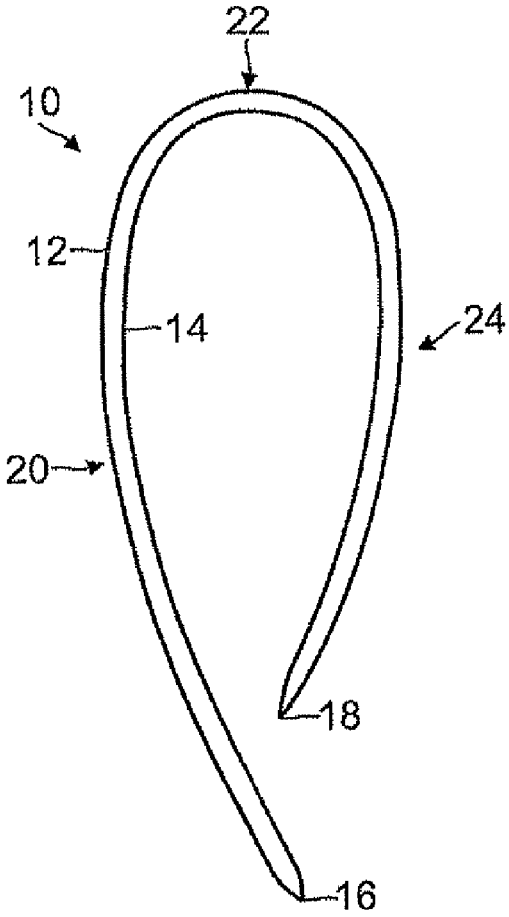
FIG. 6 is a top view of the improved packaging for rolling papers for smoking articles according to an embodiment of the present invention.
Figure 7:
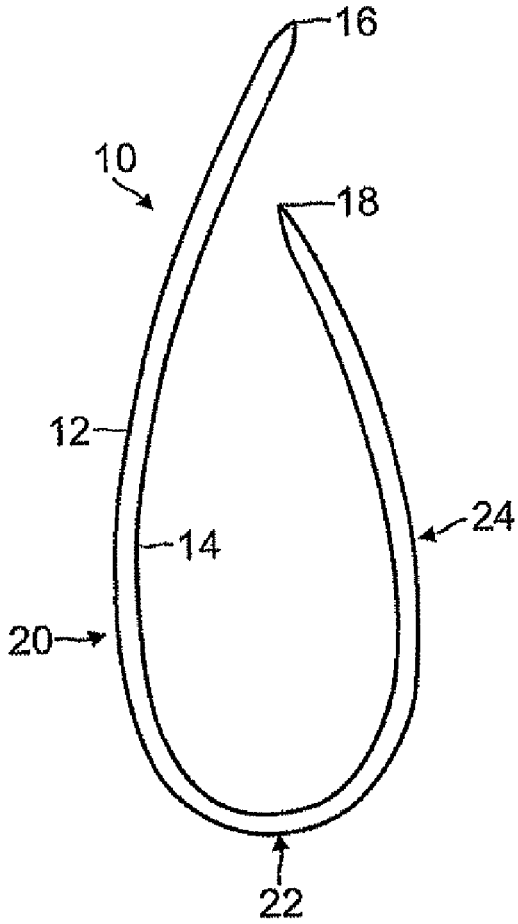
FIG. 7 is a bottom view of the improved packaging for rolling papers for smoking articles according to an embodiment of the present invention.

As is shown in FIG. 1, the members 12 and 14 each include a rear planar portion 20, a semi-cylindrical or curved portion 22 and a front planar portion 24. The members 12 and 14 may include any ridged or flexible material, such as plastic, paper, metal, and the like, which may be configured to generally maintain a curved shape. The rear planar portion 20 and the front planar portion 24 are substantially straight. However, as shown in FIGS. 1, 6 and 7, the rear planar portion 20 and the front planar portion 24 may include a minimal curve.

One or more rolling papers are configured to be non-permanently held between members 12 and 14. The packaging 10 is configured such that one or more rolling papers, positioned between members 12 and 14, may be removed by an end user by means of the at least one opening of the members 12 and 14. The front planar portion of member 12 may optionally include a semi-circular cutout portion 26 configured such that the end user may more easily remove rolling papers from the packaging 10 using preferably the end user's finger or thumb.

In an embodiment of the invention, the semi-cylindrical portion 22 has a diameter of approximately 16 millimeters, and members 12 and 14 have a length of approximately 67.5 millimeters and a height of approximately 117.5 millimeters.

In an embodiment of the invention, packaging 10 is packaged within a sealed plastic, paper, or metallic pouch or container in order to provide additional protection to the packaging 10 and the rolling paper contained therein.

In an embodiment of the invention, the packaging 10 also includes a re-sealable pouch or container (not shown) that conforms to the opening formed by the interior walls of material 14. The re-sealable pouch or container may be used for storing tobacco or other materials used in smoking articles.

In an embodiment of the invention, an improved packaging 10 for rolling papers for smoking articles is prepared by connecting a pair of substantially parallel members 12 and 14 together at each end portion, 16 and 18, to form a generally open interior there between. The members 12 and 14 are arranged to extend along a path between the ends. The path includes a substantially straight rear planar portion 20, a semi-cylindrical portion 22 and a substantially straight front planar portion 24. A plurality of rolling papers are removably packaged between materials 12 and 14. The one or more rolling papers at least initially retain a curved shape of the path of the pair of members 12 and 14 after removal from the packaging 10. The packaging 10 may optionally be packaged within a sealed pouch or container in order to provide additional protection to the packaging 10 and the rolling paper contained therein.

Using the present invention, an end user removes one or more rolling papers from an improved packaging 10 for rolling papers for smoking articles. A user then places a desired amount of a tobacco product in the curved portion of the rolling paper, and rolls the rolling paper into a tubular shape. The curved portion of the rolling paper results from the rolling paper retaining the curved shape of the semi-cylindrical portion 22 of members 12 and 14 after its removal. The tubular shape then is sealed using adhesive or moisture, and allowed to dry to form a shell which contains the tobacco product. After drying, the smoking article may be smoked by the end user. Because the one or more rolling papers at least initially retain a curved shape after removal from the packaging 10, the rolling paper is more accessible and stable for the addition of the tobacco product, and an end user is not required to first unroll the rolling paper before adding such tobacco. The present invention also eliminates the possibility of recoil of the rolling papers and undesirable air channels due to a pre-existing fold though which air may be pulled in the smoking article.

The present invention may also be used as a tool to improve the characteristics of a rolled smoking article. In this embodiment, the packaging is comprised of a thin plastic or other flexible material. Once the smoking article has been rolled but before it is sealed, the end user places the smoking article on the inner wall 14 of the curved portion 22 of the packaging 10 and rolls the smoking article repeatedly back and forth while maintain pressure on the smoking article and tobacco therein. In this manner, the tobacco is further compressed and the rolling paper is further tightened around the tobacco. The end user continues this process until the smoking article has the desired firmness, thereby further reducing the likelihood of air channels, as discussed above, and reducing the burn rate of the smoking article when consumed.

Referring now to FIGS. 8-11, an improved packaging 10 for rolling papers according to another embodiment of the present invention is shown. The packaging 10 includes a single member having an inner surface 140 and outer surface 120. The single member is folded over towards the inner surface 140 at each end portion, 16 and 18. Optionally, the member may be folded towards the inner surface 140 at only one end portion, 16 or 18.

Figure 8:
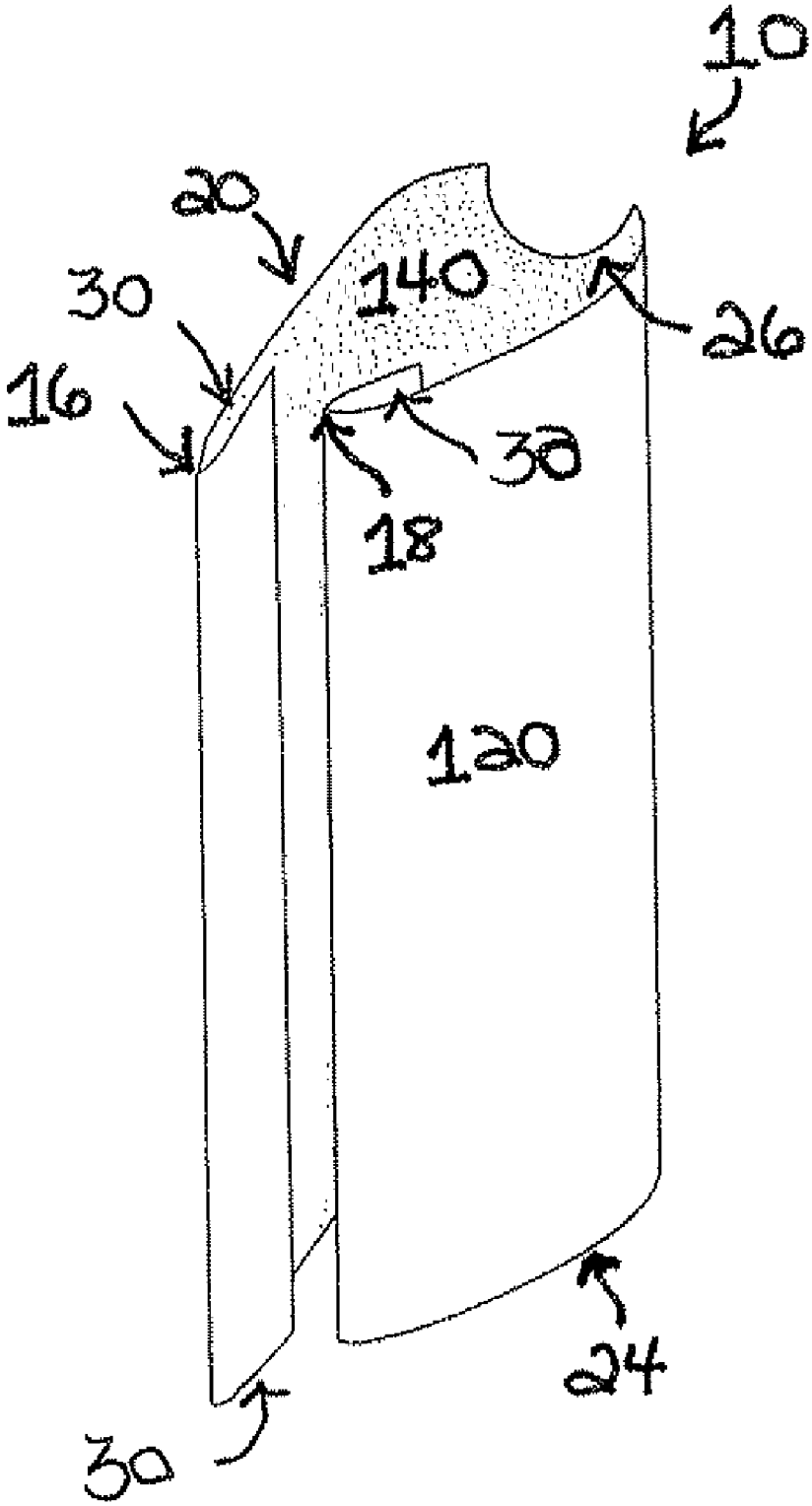
FIG. 8 is a side perspective view of an improved packaging for rolling papers for smoking articles according to an embodiment of the present invention.

The folded portions of the member form substantially parallel portions, 30 and 32, at each of the respective end portions, 16 and 18, and a generally open interior there between. As shown in FIG. 8, in the folded portions of the member, openings extend from a top portion of each of the substantially parallel portions, 30 and 32, substantially there through to a bottom portion of the respective substantially parallel portions, 30 and 32. In the unfolded portions of the member, the opening extends from the top portion of the member to an opening at the bottom portion of the member.

Figure 11:
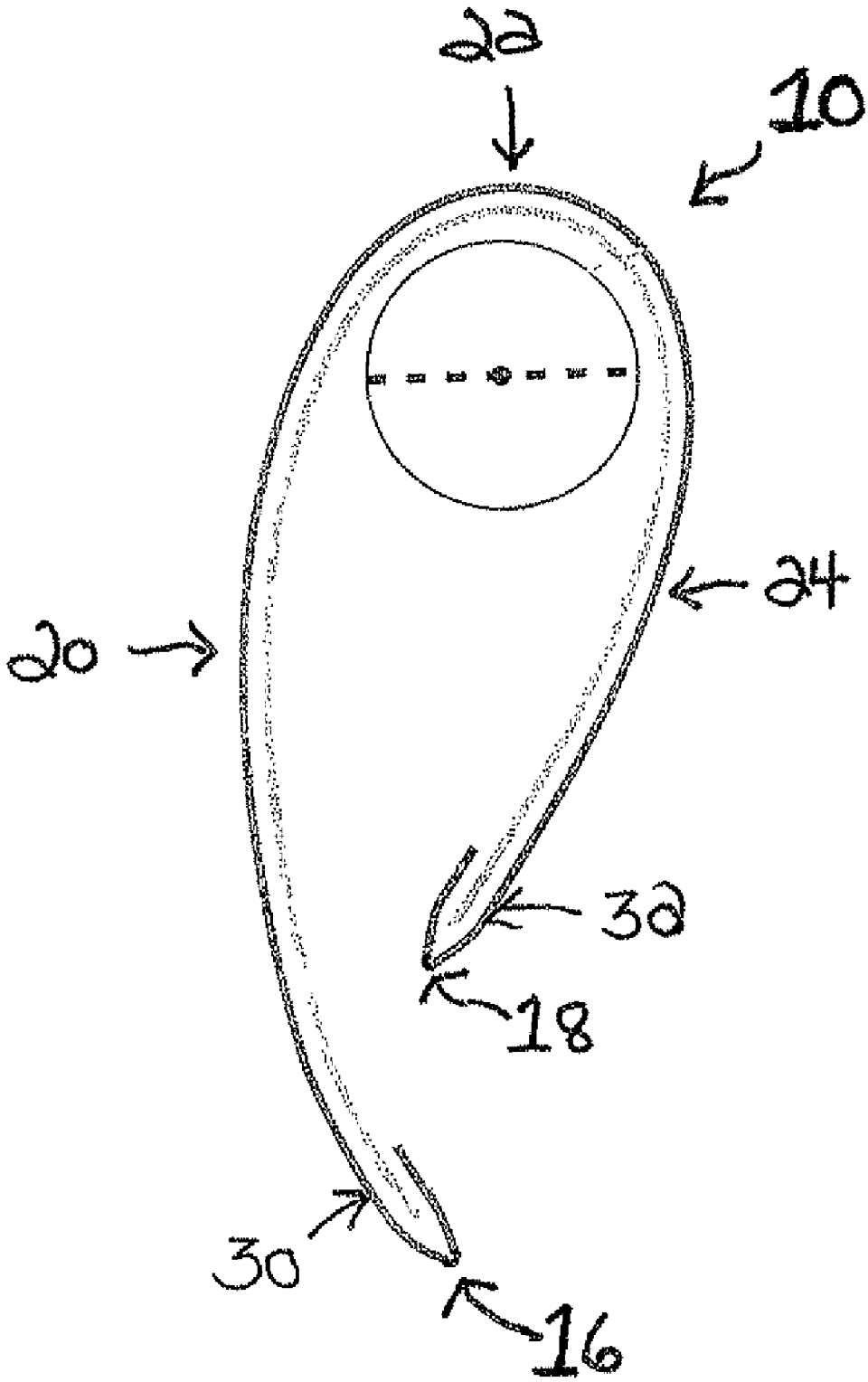
FIG. 11 is a top view of the improved packaging for rolling papers for smoking articles according to an embodiment of the present invention.

As shown in FIG. 11, the unfolded portion of the member includes a rear planar portion 20, a semi-cylindrical portion 22 and a front planar portion 24. The member may include any ridged or flexible material, such as plastic, paper, metal, and the like, which may be configured to generally maintain a curved shape. The rear planer portion 20 and front planar portion 24 are substantially straight. However, as shown in FIGS. 8 and 11, the rear planar portion 20 and front planar portion 24 may include a minimal curve.

One or more rolling papers are configured to be non-permanently held between the pair of substantially parallel portions, 30 and 32. The packaging 10 is configured such that one or more rolling papers, positioned between the pair of substantially parallel portions, 30 and 32, may be removed by an end user by means of the at least one opening of the member.

In an embodiment of the invention, the semi-cylindrical portion 22 of member may optionally include a semi-circular cutout portion 26 at the top edge of the member configured such that the end user may more easily remove rolling papers from the packaging 10 using preferably the end user's finger or thumb. Optionally, the rear planar portion 20 or the front planar portion 24 may include a semi-circular cutout portion 26 at the top edge of the member configured such the end user may more easily remove the rolling papers.

Figure 9:
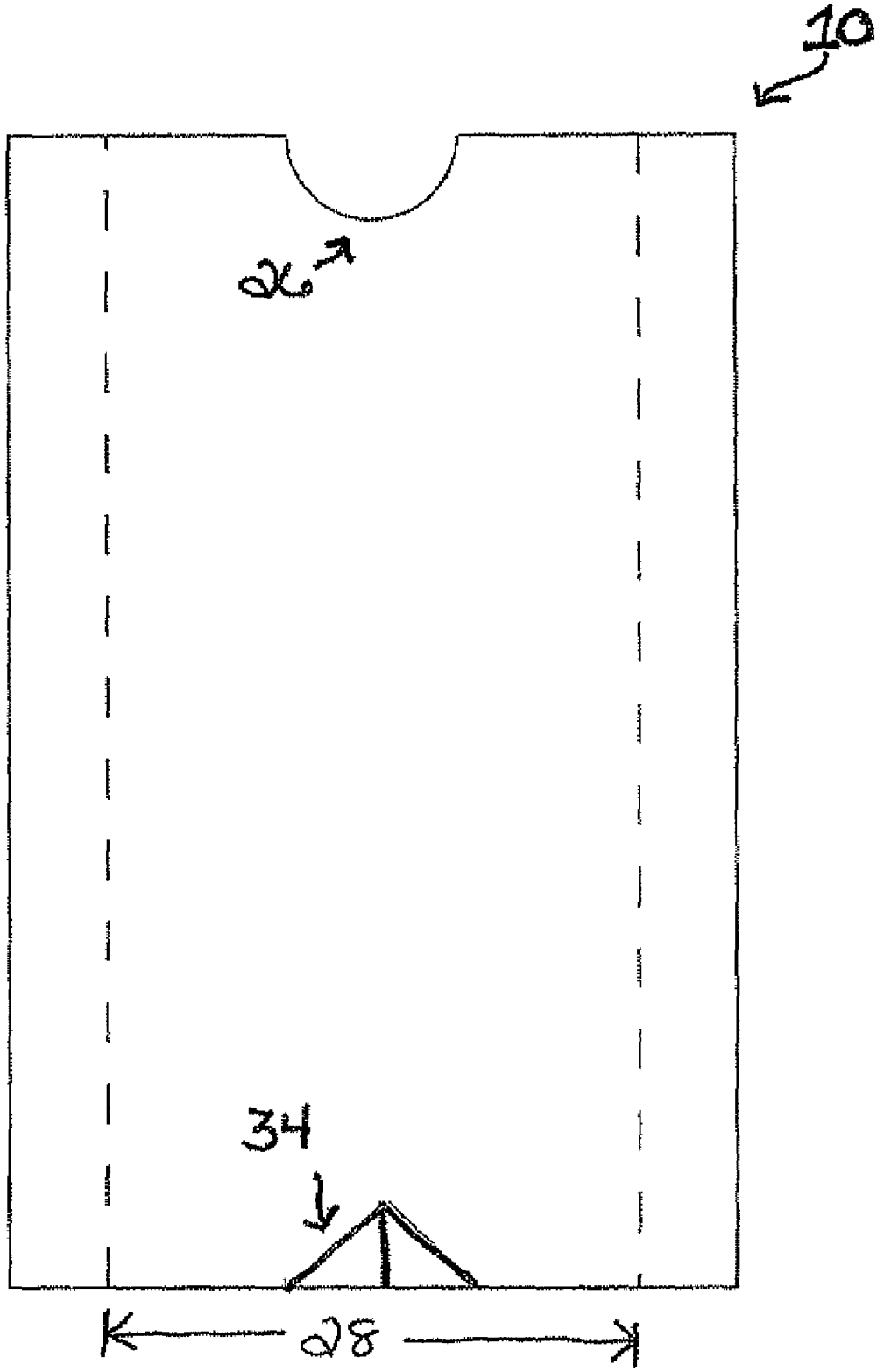
FIG. 9 is a flat, side view of the improved packaging for rolling papers for smoking articles according to an embodiment of the present invention.
Figure 10:
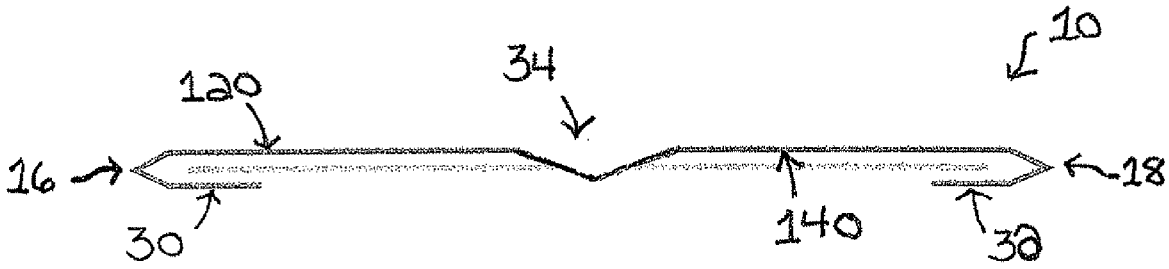
FIG. 10 is a flat, top view of an improved packaging for rolling papers for smoking articles according to an embodiment of the present invention.

In an embodiment of the invention, the semi-cylindrical portion 22 of the member may include optionally an obstruction, such as, an inwardly folded tuck portion 34, at the bottom edge of the member configured such that the rolling papers are positioned under the semi-circular cutout portion 26. Optionally, the rear planar portion 20 or the front planar portion 24 may include an inwardly folded tuck portion 34 in the bottom edge of the member configured such that the rolling papers are positioned under the semi-circular cutout portion 26. As shown in FIGS. 9 and 10, an inwardly folded tuck portion 34 at the bottom edge of the semi-cylindrical portion 22 may be configured opposite to a semi-circular cutout portion 26 at the top edge of a semi-cylindrical portion 22. However, the inwardly folded tuck portion 34 may be at the bottom edge of either the rear planar portion 20 or the front planar portion 24 while the semi-circular cutout portion 26 is at the top edge of the semi-cylindrical portion 22, or vise versa. A similar obstruction may be provided by applying a strip or drop of adhesive along the bottom edge or by inwardly folding all or part of that edge.

In an embodiment of the invention, the semi-cylindrical portion 22 has a diameter of approximately 11 to 16 millimeters, the unfolded portion 28 of the member has a length of approximately 55 millimeters and a height of approximately 120 millimeters, and the folded portions of the member have a length of approximately 10 to 20 millimeters and a height of approximately 120 millimeters. The folded portions form the pair of substantially parallel portions, 30 and 32, at the respective end portions, 16 and 18. For example, one folded portion may have a length of approximately 10 millimeters, and the other folded portion may have a length of approximately 20 millimeters.

In an embodiment of the invention, the semi-cylindrical portion 22 has a diameter of approximately 11 to 16 millimeters, the unfolded portion 28 of the member has a length of approximately 67.5 millimeters and a height of approximately 108 millimeters, and the folded portion has a length of approximately 10 to 20 millimeters and a height of approximately 108 millimeters. For example, one folded portion may have a length of approximately 10 millimeters, and the other folded portion may have a length of approximately 20 millimeters.

In one optional embodiment of the invention, packaging 10 is packaged within a sealed plastic, paper, or metallic pouch or container in order to provide additional protection to the packaging 10 and the rolling paper contained therein.

In an embodiment of the invention, the packaging 10 also includes a re-sealable pouch or container (not shown) that conforms to the opening formed by the inner surface 140 of the member. The re-sealable pouch or container may be used for storing tobacco or other materials used in smoking articles.

In an embodiment of the invention, an improved packaging 10 for rolling papers for smoking articles is prepared by folding each end, 16 and 18, of a single member having an inner surface 140 and outer surface 120 towards the inner surface 140 to form substantially parallel portions, 30 and 32, at each respective end, 16 and 18, and a generally open interior, arranging the unfolded portion 28 of the member to extend along a path between the ends, 16 and 18, and removably packaging a plurality of rolling papers between the pair of substantially parallel portions, 30 and 32. The unfolded portion 28 of the member extends along a path between the ends, 16 and 18. The path includes a substantially straight rear planar portion 20, a semi-cylindrical portion 22 and a substantially straight front planar portion 24. A plurality of rolling papers are removably packaged between the pair of substantially parallel portions, 30 and 32. The one or more rolling papers at least initially retain a curved shape after removal from the packaging 10. The packaging 10 may optionally be packaged within a sealed pouch or container in order to provide additional protection to the packaging 10 and the rolling paper contained therein.

Using the present invention, an end user places a desired amount of tobacco on the exposed sheet of rolling paper corresponding to the inner surface 140 of the improved packaging 10. The end user may manipulate the packaging 10 to compress and form, i.e., pre-form, the tobacco into a tubular shape before the paper is rolled to create a smoking article. To roll the smoking article, the ends of a rolling paper can be removed from under the substantially parallel portions 30 and 32, and the packaging 10, which is made of a flexible material, such as, a thin plastic, in this embodiment, can be used to roll the smoking article without removing the paper therefrom.

Alternately, after the packaging 10 has been used to preform the tobacco, the paper and tobacco can be removed from the packaging 10 to roll a smoking article. When removed from the improved packaging 10, the rolling paper at least initially retains a curved shape, which may be substantially the same as the path of the curved portion 22 of the member, thereby retaining the pre-formed tobacco and allowing the end-user to create a suitable smoking article without reshaping or folding the rolling paper. Once formed, the end user may place the smoking article on the inner surface 140 of the curved portion 22 of the improved packaging 10, and manipulate the packaging so that the smoking article is rolled repeatedly, exerting pressure as the smoking article is rolled forward and releasing the pressure when the cigarette is returned to its original position within the curved portion 22 of the packaging 10, thereby further compressing the tobacco within the smoking article and further tightening the rolled paper around the tobacco to create an improved smoking article, having the preferred characteristics discussed above. Once the desired characteristics are obtained, the exposed end of the paper is scaled to the smoking article by applying moisture or using various adhesives known in the art. The present invention eliminates the problems associated with the recoil of the rolling papers and the undesirable air channels in the smoking article more common with conventionally packaged rolling papers. The improved packaging 10 also supports the rolling paper as the end user pre-forms the tobacco before the paper is removed from the packaging, thereby making it easier to create the roll your own smoking article once the paper is removed from the packaging and lessening the likelihood that the paper will be damaged when the smoking article is created. Further, the improved packaging 10 can be used by an end user as a tool that makes it easier to roll the smoking article, once the tobacco is pre-formed, and also as a tool to improve the characteristics of a smoking article rolled any an end-user without using the improved packaging 10.

Obviously, many other modifications and variations of the present invention are possible in light of the above teachings.

The specific embodiments discussed herein are merely illustrative, and are not meant to limit the scope of the present invention in any manner. It is therefore to be understood that within the scope of the disclosed concept, the invention may be practiced otherwise than as specifically described.

The invention claimed is:

1. An improved rolling paper packaging for roll your own smoking articles, the rolling paper packaging comprising:

a single planar member having an inner and outer surface, the planar member having oppositely-positioned proximal and distal ends, each of which are folded over towards the inner surface to form a substantially parallel portion at each folded end, wherein each said parallel portion includes a generally open interior there-between, the remaining portion of the planar member extending along a path between the proximal and distal ends, the path including at least one substantially flat portion and a semi-cylindrical portion, wherein the single member does not comprise sheet metal; and one or more rolling papers removably packaged between the pair of substantially parallel portions.

2. The improved packaging of claim 1, wherein the one or more rolling papers at least initially retains a curved shape after removal from the improved rolling paper packaging.

3. The improved packaging of claim 1, wherein the substantially flat portions include a minimal curve.

4. The improved packaging of claim 3, wherein tobacco may be placed within one or more rolling papers without requiring a user to first unroll the one or more rolling papers.

5. The improved packaging of claim 1, wherein the semi-cylindrical portion includes a cutout portion at an opening configured to allow a user to remove one or more rolling papers.

6. The improved packaging of claim 5, wherein the substantially flat portion includes a cutout portion at the opening configured to allow a user to remove one or more rolling papers.

7. The improved packaging of claim 5, wherein the semi-cylindrical portion includes an obstruction at the opening configured to position one or more rolling papers under the cutout portion.

8. The improved packaging of claim 7, wherein the obstruction is comprised of an inwardly folded tuck portion at the opening configured to position one or more rolling papers under the cutout portion.

9. The improved packaging of claim 1, wherein the single member is substantially ridged.

10. The improved packaging of claim 1, wherein the single member comprises a flexible plastic.

11. The improved packaging of claim 1, wherein the single member comprises paper.

12. The improved packaging of claim 1, wherein the path includes two flat portions, wherein the semi-cylindrical portion is arranged between the two flat portions.

13. The improved packaging of claim 12, wherein the semi-cylindrical portion has a diameter of at least 11 millimeters.

14. The improved packaging of claim 12, wherein the path has a length of at least 55 millimeters.

15. The improved packaging of claim 12, wherein the substantially parallel members have a length of at least 10 millimeters and a height of at least 108 millimeters.

16. The improved packaging of claim 12, wherein one of the two substantially straight planar portions is longer than the other substantially straight planar portion.

* * * * *